US010199714B2

(12) United States Patent
Ge et al.

(10) Patent No.: US 10,199,714 B2
(45) Date of Patent: Feb. 5, 2019

(54) WIRELESS LED TUBE LAMP DEVICE

(71) Applicant: PHILIPS LIGHTING HOLDING B.V., Eindhoven (NL)

(72) Inventors: Xiaodong Ge, Eindhoven (NL); Gang Li, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/519,907

(22) PCT Filed: Oct. 25, 2015

(86) PCT No.: PCT/EP2015/074687

§ 371 (c)(1),
(2) Date: Apr. 18, 2017

(87) PCT Pub. No.: WO2016/066564

PCT Pub. Date: May 6, 2016

(65) Prior Publication Data

US 2017/0244148 A1 Aug. 24, 2017

(30) Foreign Application Priority Data

Oct. 27, 2014 (WO) ..... PCT/CN2014/089588
Dec. 19, 2014 (EP) ..... 14199314

(51) Int. Cl.

| | |
|---|---|
| ***H01Q 9/42*** | (2006.01) |
| ***H01Q 1/22*** | (2006.01) |
| ***F21V 23/00*** | (2015.01) |
| ***F21K 9/278*** | (2016.01) |
| ***H01Q 9/26*** | (2006.01) |

(Continued)

(52) U.S. Cl.
CPC ..... *H01Q 1/22* (2013.01); *F21K 9/278* (2016.08); *F21V 23/00* (2013.01); *F21V 23/003* (2013.01); *H01Q 9/265* (2013.01); *H01Q 21/062* (2013.01); *F21Y 2103/10* (2016.08); *F21Y 2115/10* (2016.08); *H05B 37/0272* (2013.01)

(58) Field of Classification Search
CPC ..... H01Q 1/22; H01Q 21/062; H01Q 9/265
USPC ..... 343/721
See application file for complete search history.

(56) References Cited

U.S. PATENT DOCUMENTS 6,539,917 B2 * 4/2003 Shaw ..... F02M 35/1211 123/339.1
7,938,562 B2 * 5/2011 Ivey ..... F21V 33/0052 362/276

(Continued)

FOREIGN PATENT DOCUMENTS

CN 201672299 U 5/2010
JP 2009141766 6/2009

(Continued)

*Primary Examiner* — Lam T Mai
(74) *Attorney, Agent, or Firm* — Akarsh P. Belagodu

(57) ABSTRACT

A wireless LED tube lamp device (100) comprises: an at least partially transparent tube (7); at least one LED (1) arranged within said tube; at least one LED driver (4); a LED controller (5); an RF antenna (30; 40) coupled to the controller for receiving and sending wireless commands. The RF antenna is a curved antenna having antenna elements (31, 32, 33; 41, 42, 43) located in a common curved plane wherein said antenna comprises an array of half-loop wire antenna, and said array of half-loop wire antenna comprises a plurality of coils of line.

12 Claims, 14 Drawing Sheets

(51) Int. Cl.

| | |
|---|---|
| ***H01Q 21/06*** | (2006.01) |
| *F21Y 103/10* | (2016.01) |
| *F21Y 115/10* | (2016.01) |
| *H05B 37/02* | (2006.01) |

(56) References Cited

U.S. PATENT DOCUMENTS

| | | | | |
|---|---|---|---|---|
| 8,113,689 | B2 * | 2/2012 | Mayo | F42B 12/36 102/367 |
| 8,251,544 | B2 * | 8/2012 | Ivey | F21V 33/0052 362/276 |
| 8,398,258 | B1 | 3/2013 | Gerrish et al. | |
| 2010/0027249 | A1 * | 2/2010 | Connor | F21L 4/08 362/183 |
| 2011/0006898 | A1 | 1/2011 | Kruest et al. | |
| 2013/0328481 | A1 | 12/2013 | Hiroi | |

FOREIGN PATENT DOCUMENTS

| | | | |
|---|---|---|---|
| WO | WO2010140136 | A1 | 12/2010 |
| WO | WO2013037585 | A1 | 3/2013 |

* cited by examiner

WIRELESS LED TUBE LAMP DEVICE

CROSS-REFERENCE TO PRIOR APPLICATIONS

This application is the U.S. National Phase application under 35 U.S.C. § 371 of International Application No. PCT/EP2015/074687, filed on Oct. 25, 2015, which claims the benefit of European Patent Application No. 14199314.7, filed on Dec. 19, 2014, and Chinese Patent Application No. PCT/CN2014/089588, filed on Oct. 27, 2014. These applications are hereby incorporated by reference herein.

FIELD OF THE INVENTION

The present invention relates in general to the field of lighting, particularly to the field of LED lighting.

BACKGROUND OF THE INVENTION

A TL lamp is a conventional and well-known type of lamp. It generally comprises a gas-filled tube and two spaced-apart electrodes, which receive electrical power. In order to be able to power such lamp from AC mains, typically 230 V @ 50 Hz in Europe, a TL lighting system comprises a ballast, and for starting the lamp the system conventionally includes a starter switch. While a conventional ballast is a cupper ballast, more advanced ballasts are electronic ballasts.

In the past years, LED lighting technology has been rapidly developed, and LEDs have been more and more used for the purpose of illumination as an alternative to incandescent or TL lamps. However, there is also a desire for retrofit, i.e. it is desirable to provide an LED lamp device that has the shape of a standard TL lamp, i.e. a tube shape, and that can be used to replace such standard TL lamp. This shape puts restrictions on the space that is available for the components of the lamp device.

A specific class of tube-shaped LED lamps relates to lamps that can be remote controlled, i.e. wirelessly controlled, using RF signals. Such lamp will in the context of the present invention be indicated as "wireless LED tube lamp device". One of the essential components of such lamp device is an antenna for receiving command signals. For good performance, size is an important feature of such antenna, but size is limited in an LED tube lamp device: the size of structural components must obviously be less than the tube diameter.

Another important component of such lamp device is an elongate metal spine running a substantial part of the entire length of the tube. This spine has two important functions: on the one hand it gives rigidity to the tube, on the other hand it acts as a heat sink for the LEDs. Electronic circuitry are located at the far ends of the tube, adjacent the spine. This electronic circuitry includes for instance driver electronics for the LEDs. This electronic circuitry also includes a wireless control circuit with an antenna.

US20130328481A1 disclosed a LED tube with a curved cover part, and an antenna is affixed to the curved cover part.

SUMMARY OF THE INVENTION

A problem is that the long metal spine disturbs the radiation field around the tube, affecting the wireless reception. Particularly, wireless reception at one end of the tube is very weak.

It would be advantageous to have a wireless LED tube lamp device with better radiation performance. Further, it would be advantageous to have an antenna design for a wireless LED tube lamp device that improves the radiation performance. It would be advantageous to design an antenna that better utilizes the tube shape of the LED tube lamp.

In one aspect, the present invention provides a wireless LED tube lamp device, comprising:

an at least partially transparent tube;

at least one LED arranged within said tube;

at least one LED driver for driving said at least one LED;

a controller for controlling said at least one LED driver;

an RF antenna coupled to the controller for receiving and sending wireless commands;

wherein the RF antenna is a curved antenna having antenna elements located in a common curved plane wherein said antenna comprises an array of half-loop wire antenna, and said array of half-loop wire antenna comprises a plurality of coils of line.

An advantage of this is that the antenna can be larger while still fitting in the lamp device, namely having a nice utilization of the tube shape of the tube lamp. Thus the radiation performance can be improved. In real embodiment, the size of the LED tube lamp can support the half-loop wire antenna of 5 GHz, which is a promising frequency band in the Wi-Fi and Zigbee development roadmap.

In a possible embodiment, particularly fitting in a tube with circular cilindrical shape, said plane is a circular cilindrical plane.

In a possible embodiment, said antenna elements are self-supporting and said plane is a virtual plane. This embodiment proposes one implementation of the curved antenna, and the antenna is formed into and keeps the curved shape. Thus the curved antenna can be assembled into the tube lamp directly, and less components are needed.

In another possible embodiment, that has the advantage of being particularly cost-efficient and easy to manufacture, said antenna elements are arranged on a support having a curved outer surface.

Advantageously, said antenna elements are arranged on a bent sheet, preferably flexible and at least partially transparent PCB, and said sheet is placed within and bent to form said plane by said tube. In this embodiment, it is very simple and low cost to arrange, such as print or deposit the antenna onto such flexible sheet, and no more extra processing is applied on the sheet to make it curve since the inner cavity will bent the sheet.

In prior art, the antenna is located within an end cap of the lamp device. In a preferred embodiment of the present invention, the antenna is located within said tube, where more space is available so the antenna can be larger.

In prior art, there is only one antenna. In preferred embodiments of the invention, the lamp device comprises two curved RF antennas arranged at opposite ends of the tube and/or two curved RF antennas arranged at one end of the tube, mounted diametrically opposite to each other.

In another aspect, the present invention provides a Yagi-Uda antenna comprising an elongate feeder element, an elongate reflector element arranged at one side of the feeder element, and one or more elongate director elements arranged at the opposite side of the feeder element, wherein said elongate elements are arranged in mutually parallel virtual planes perpendicular to a main transmission direction of the antenna, and wherein each of said elongate elements is curved within the corresponding virtual plane around a common axis parallel to said main transmission direction.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
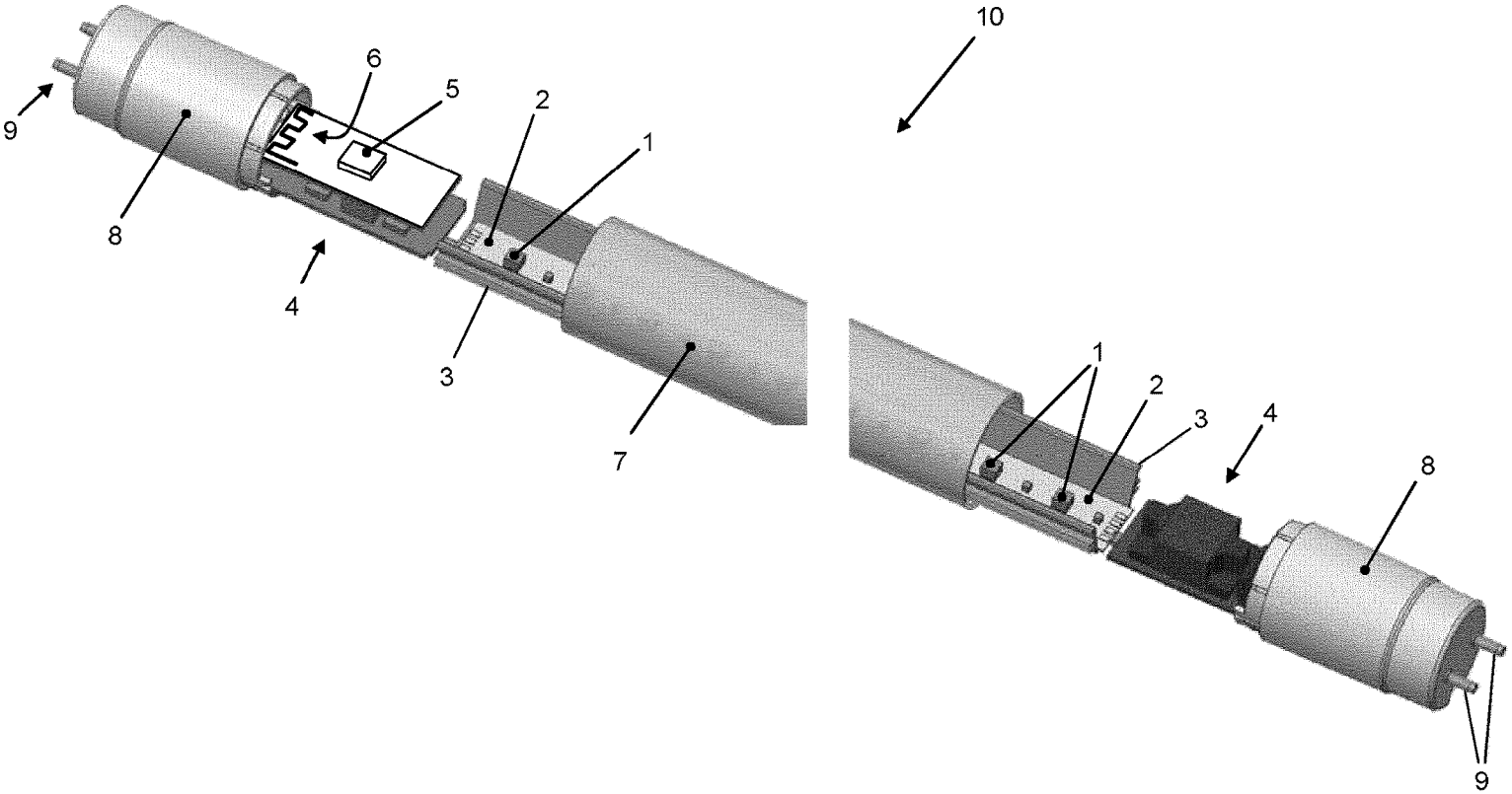
FIG. 1 is a schematic perspective view of a prior art wireless LED tube lamp device.

FIG. 1 schematically shows a prior art wireless LED tube lamp device 10. It can be seen that it has a generally elongate tube-shaped design. Reference number 8 indicates end caps at the ends of the device 10, for housing electronic circuits and carrying the electrical connector pins 9 for connecting to mains. Each end cap accommodates a mains power converter annex LED driver 4. One of the end caps, in this case the lefthand cap, also accomodates a PCB arranged above the corresponding power converter 4 and having mounted thereon a printed circuit RF antenna 6 and a wireless controller 5, for receiving and sending wireless commands and for controlling the LED drivers 4. An at least partially transparent tube 7, made of glass or plastic, extends between the end caps 8. Within the tube 7, an elongate strip 2 of PCB is arranged, having LEDs 1 mounted thereon. The PCB strip 2 is connected to the power converters 4 and has circuitry for distributing the power to the LEDs 1. The PCB strip 2 is mounted on an elongate metal heat sink 3, for taking up and conducting away heat generated by the LEDs. This heat sink 3 has a generally U-shaped cross-section, and will also be indicated as "spine" since it also gives rigidity to the device.

It is noted that the antenna 6 is placed at one end of the device 10. The radiated power from the antenna will be blocked and/or reflected by the long metal structure 3 and also partially by the long LED strip 2.

An objective of the invention is to improve on this prior art design.

One aspect of the invention involves the application of a curved Yagi-Uda antenna, as an addition to the existing antenna 6 or to replace this antenna 6. The curved Yagi-Uda antenna can be arranged at one end of the tube only, as in the prior art design, or two curved Yagi-Uda antennas can be arranged at both ends.

Figure 2:
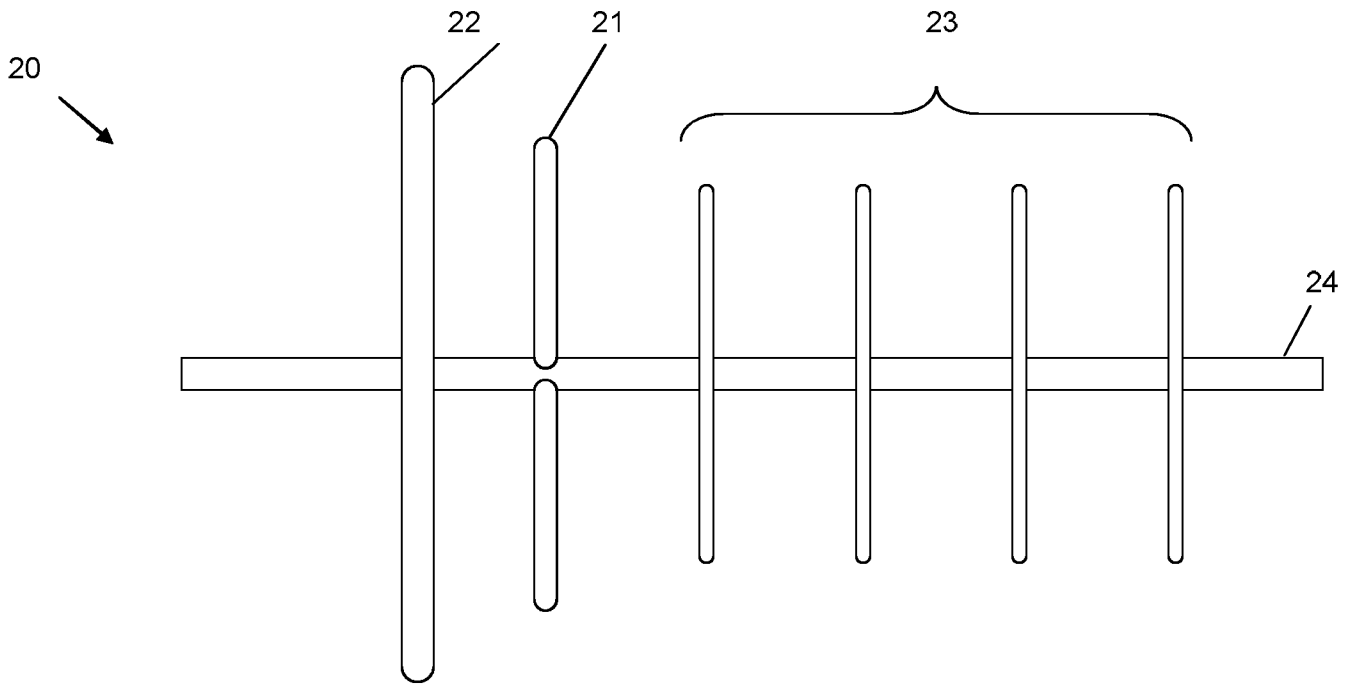
FIG. 2 schematically illustrates the general design of a Yagi-Uda antenna.

A Yagi-Uda antenna as such is a well-known antenna design, and therefore an explanation will be kept brief. FIG. 2 schematically illustrates the general design of a Yagi-Uda antenna 20. Reference numeral 24 indicates a support for electrically conductive antenna elements 21, 22, 23, which are elongate strips or bars or wires, arranged parallel to each other in one plane, and aligned such as to be symmetric with respect to a main axis which in the example shown is directed horizontally and coincides with the elongate support 24. The main axis defines the direction of sensitivity or directivity of the antenna.

Reference numeral 21 indicates a bipolar driver element or feeder element, which via a transmission line (not shown) is connected to the signal circuitry, either for transmission or reception or both. Although the precise length may vary somewhat in different designs, the length is about half the wavelength for which the antenna is designed.

At one side of the feeder element 21, a reflector element 22 is arranged. The reflector element 22 is larger than the feeder element 21, and has the function of blocking or reflecting radiation from the feeder element 21 in one direction.

At the opposite side of the feeder element 21, one or more director elements 23 is/are arranged. Each director element 23 is shorter than the feeder element 21, typically around 0.4 times wavelength, and has the function of enhancing the signal amplitude in the main antenna direction. Typically, a gain of 10 dB in this direction is achieved. The mutual distances between two adjacent director elements 23, and between the feeder element 21 and the first director element 23, are the same, and can in an embodiment typically be around 0.34 times wavelength. The distance between the feeder element 21 and the reflector element 22 is shorter, typically around 0.25 times wavelength.

In the following, the phrase "length" of the antenna will be used for the size measured along the main antenna direction, whereas the size of the antenna perpendicular to the main antenna direction will be indicated as "width". Since the elongate elements 21, 22, 23 are directed perpendicular to the main antenna direction, their "length" corresponds to the "width" of the antenna.

When designing a Yagi-Uda antenna, different design considerations play a role, and the signal frequency to be used is an important parameter. This frequency may for instance be around 2.4 GHz, which is a frequency commonly used for remote controls. In such case, half the wavelength would correspond to about 6 cm. An antenna having such width does not fit into a tube 7 of a TL-tube size.

Given that a TL-tube has an outer diameter of around 2.5 cm, the maximum element length of a Yagi-Uda antenna, when placed in the center of the tube, could be about 2 cm or perhaps slightly more, which is too small for a proper antenna design.

According to the present invention, this problem is overcome by using a CURVED Yagi-Uda antenna. The antenna is curved around an axis parallel to the length direction of the axis, so that the antenna elements are curved. In this way, the largest antenna element can have a length larger that the tube diameter. Though not essential, the curved shape of the elements is preferably a circular arc, i.e. a portion of a circle. In an example where the radius of curvature is 1 cm, resulting in an antenna diameter of 2 cm easily fitting in the tube 7, the curved length of the largest antenna element, i.e. the reflector 22, can be 6.28 cm, or slightly less if it is to be avoided that the opposite tips of the reflector touch each other. This would correspond to the frequency of 2.4 GHz.

The inventors have performed an experiment, wherein they have compared the performance of a Yagi-Uda antenna with that same antenna in curved condition. It was found that the curved antenna behaves as Yagi-Uda antenna, indeed, with a gain and directivity performance slightly less than the performance of the original planar antenna. However, when compared to a planar antenna having a width equal to the width (i.e. diameter) of the curved Yagi-Uda antenna, the curved Yagi-Uda antenna performs much better.

The following description elucidates embodiments of the invention by putting the Yagi-Uda antenna into curved shape. Several methods are envisaged for making the curved Yagi-Uda antenna, resulting in corresponding design characteristics of the antenna.

Figure 3:
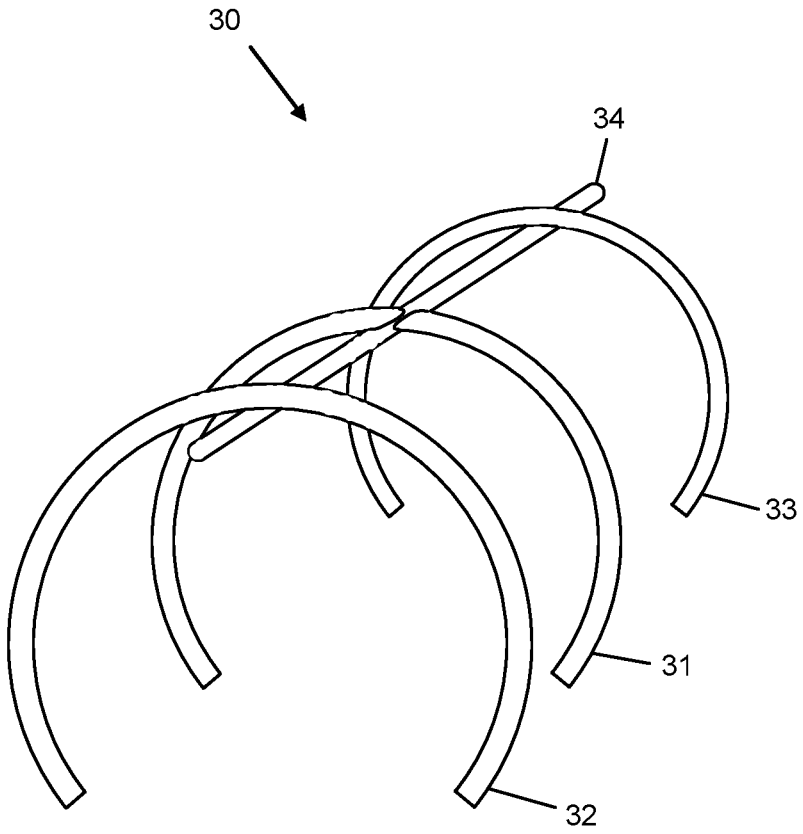
FIG. 3 is a perspective view schematically illustrating a first possible design of a curved Yagi-Uda antenna.

FIG. 3 is a perspective view schematically illustrating a first possible design of a curved Yagi-Uda antenna 30 where the antenna elements feeder 31, reflector 32 and director 33 are implemented as sufficiently rigid, self-supporting elements held in place by a common support 34. The elements may for instance be made as bent metal wires or bars. Each element is bent within a virtual plane, all of these virtual planes being mutually parallel and perpendicular to the main antenna axis. The bending shape is such that, viewed in the direction of the main antenna axis, all elements are projected upon each other. Preferably, the bending is such that the radius of curvature is constant over the length of each element, while each element has the same radius of curvature but with different length (real circumference); in such case, all elements are located in a virtual circular cilindrical plane. Preferably, the circular cilindrical plane matches the inner cilindrical surface of the tube.

The figure shows only one director 33, but the number of directors may be equal to two or more.

Figure 4:
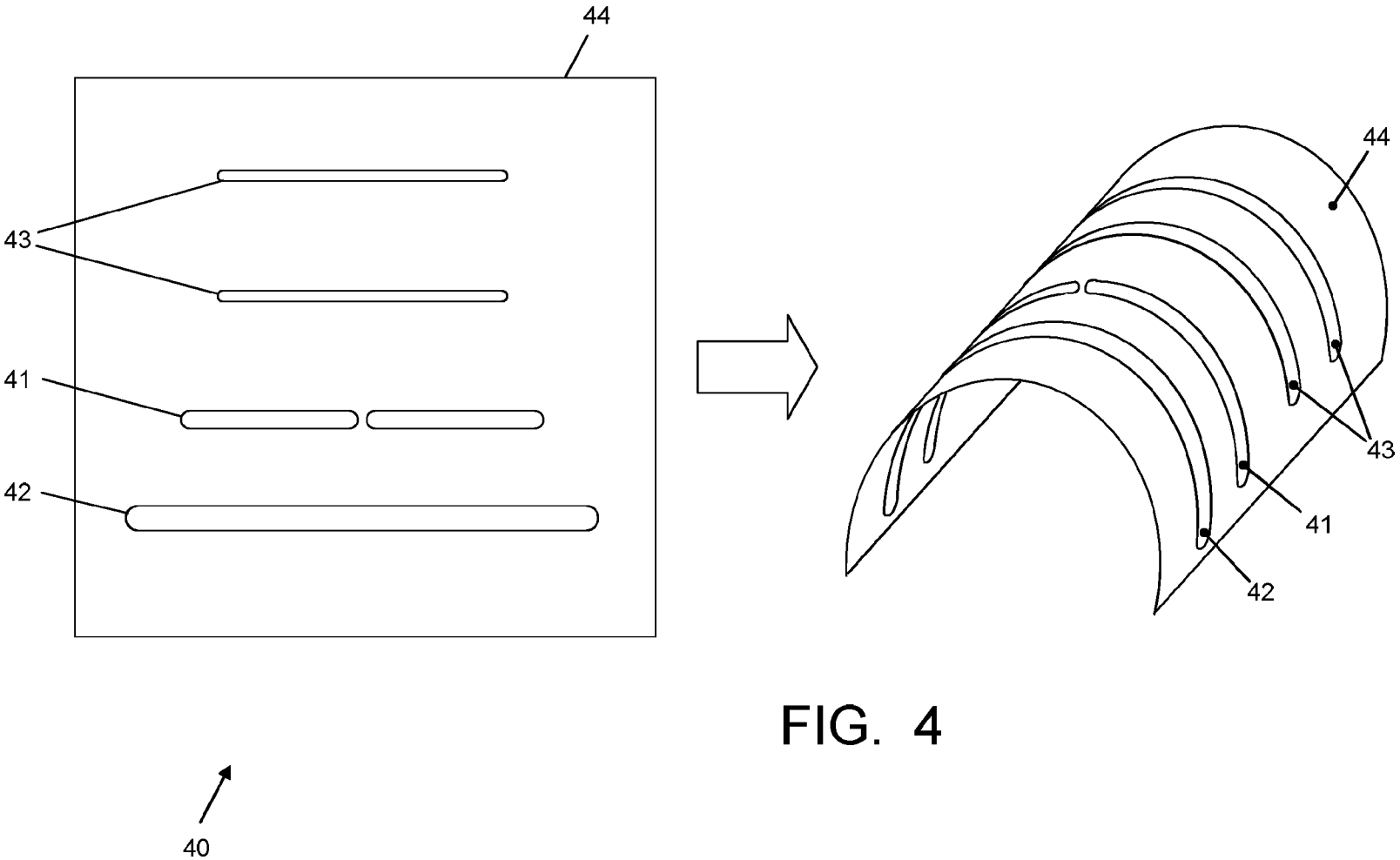
FIG. 4 illustrates a possible method for forming a curved Yagi-Uda antenna.

FIG. 4 illustrates another method for forming a curved Yagi-Uda antenna 40. Reference numeral 44 indicates a flexible PCB sheet, having formed thereon mutually parallel antenna elements feeder 41, reflector 42 and director 43. In this example, two director elements are shown. The elements are thin; in the figure, their width is shown exaggeratedly large. As regards length and spacing, the antenna elements are designed in accordance to normal and known design rules for a planar antenna. Subsequently, the PCB sheet 44 is bent around an axis perpendicular to the antenna elements, such that the PCB sheet 44 has the form of a part of a circular cilinder and the antenna elements are directed in the circumferential direction of that cilinder.

As an alternative to a PCB sheet, a flexible and transparent sheet of plastic material could be used, carrying electrically conductive antenna elements arranged thereon. This sheet will be inserted into the tube and bent thereby as described below, such that the Yagi-Uda antenna on the sheet will be curved.

Figure 5A:
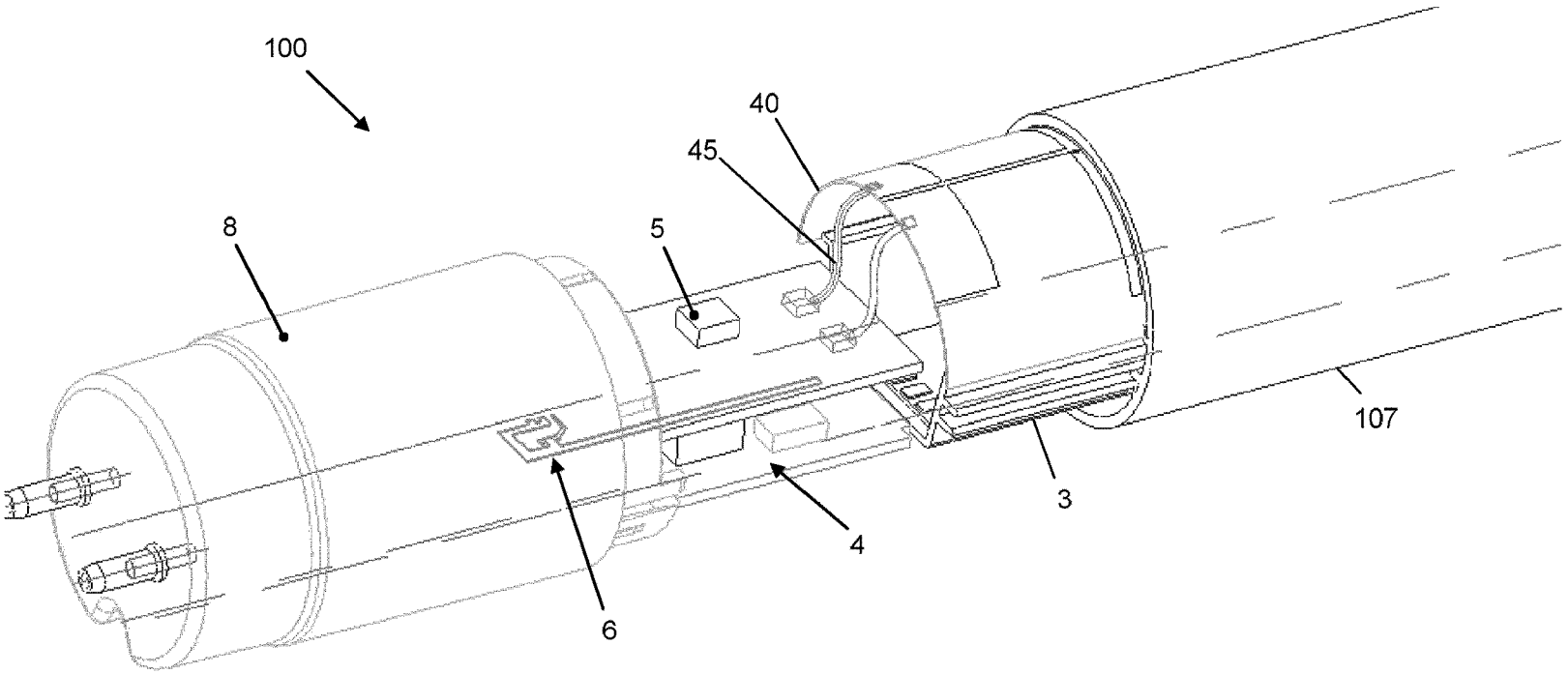
FIG. 5A illustrates schematically a wireless LED tube lamp device according to the present invention.

FIG. 5A schematically illustrates a wireless LED tube lamp device 100 according to the present invention, that is distinguished over prior art devices by having a curved Yagi-Uda antenna, in this case the antenna 40 of FIG. 4. Apart from this antenna, all other components can be identical to the components of the prior art device 10, therefore the description of these components is not repeated here. The figure shows an end portion of the tube, here indicated by reference numeral 107. Reference numeral 45 indicates a wire connecting the antenna 40 to the wireless control circuit 5. Either before or after being connected to the wireless control circuit 5 via the wires 45, the antenna 40 is inserted into the tube 107 lengthwise, with the director(s) first so that the reflector 42 is positioned at the end cap 8 side with respect to the feeder 41. The antenna can be mounted on a separate support, but in this case the antenna comes to lie against the inner surface of the tube wall. The antenna 40 covers some of the LEDs, but the flexible PCB sheet is substantially transparent so that the LED light output is not hindered.

Figure 5B:
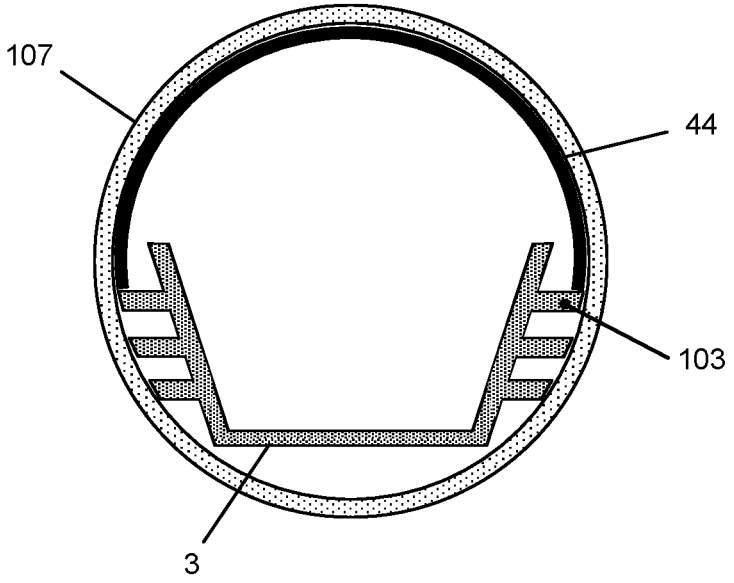
FIG. 5B is a schematic cross section of the tube of a wireless LED tube lamp device according to the present invention.

FIG. 5B is a schematic cross section of the tube 107 with the heat sink profile 3. The heat sink 3 may have fins 103 extending outwards towards the inner surface of the tube wall. The PCB sheet 44 is held in place because its longitudinal edges are supported on the fins 103.

Figure 5C:
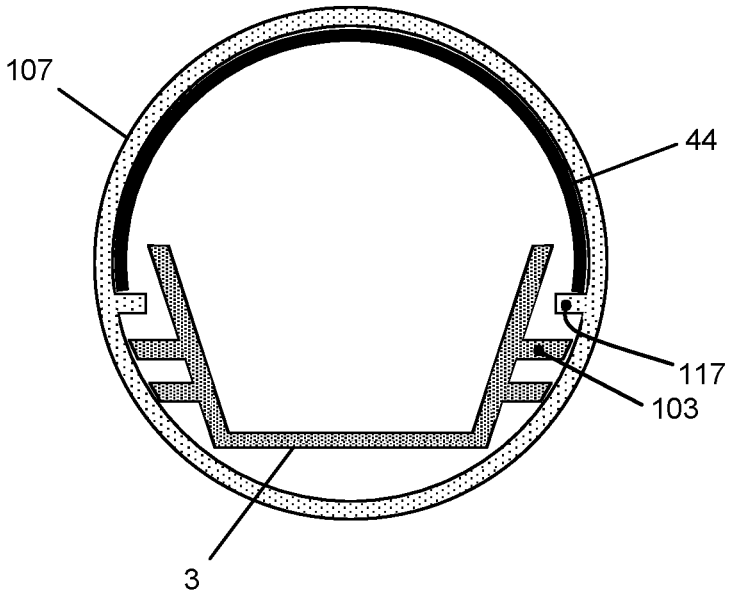
FIG. 5C is a schematic cross section of the tube of another wireless LED tube lamp device according to the present invention.

FIG. 5C is a schematic cross section of the tube 107, illustrating another embodiment. Protruding inwards from its inner surface, the tube 107 may have longitudinal ridges 117, coextruded with the tube wall. The PCB sheet 44 is held in place because its longitudinal edges are supported on the ridges 117.

In the above embodiment, the sheet may be flat in its original form but bent within the tube by the tube or by the heat sink. In an alternative embodiment, the support for the antenna has a rigid curved outer surface in its original form, providing the curved plane of the antenna. For example, the support can be thermally plasticized into the curved shape, and after the plasticization, or before the plasticization, the antenna is printed or deposited on it. And the curved support is inserted into the tube.

The curved Yagi-Uda antenna may be the only antenna in the device 100. Alternatively, as illustrated in FIG. 5A, the prior art antenna 6 is still present, which in this case is a simple PCB printed antenna but which may alternatively be a simple antenna made of wire or stamped metal, for instance. In such case, the antennas are not conneced in parallel to the wireless control circuit 5, but via a switch controlled by the wireless control circuit 5. In normal operation, the wireless control circuit 5 sets this switch such as to use the simple antenna 6 as primary antenna. This configuration will be operative when communication takes place with other devices located near the same end of the tube as the antenna 6. The curved Yagi-Uda antenna then is a secundary antenna. The wireless control circuit 5 monitors the signal quality of the received RF antenna signal, and if that quality is not good enough, the wireless control circuit 5 sets said switch such as to use the curved Yagi-Uda antenna 40. This configuration will be operative when communication takes place with other devices located at the other end of the tube. If the signal quality improves, the wireless control circuit 5 may switch back to the simple primary antenna 6.

In the above, only one curved Yagi-Uda antenna 40 is described, either as the sole antenna or as secundary antenna in conjunction with a primary antenna. In either case, it is possible to have more than one curved Yagi-Uda antenna to improve the quality of communication. For instance, it is possible to have curved Yagi-Uda antennas mounted at the opposite ends of the tube lamp device. It is also possible to have two curved Yagi-Uda antennas mounted at the same end of the tube lamp device, mounted diametrically opposite to each other, i.e. the one "above" the other with respect to a midplane of the tube, each one extending over slightly less than 180°. As a result, it is possible to have stronger signals radiated into a wider range of directions.

In the following, a theoretical comparison between "normal" and "curved" Yagi-Uda antenna will be given, and the results of some simulations will be discussed.

Figure 6:
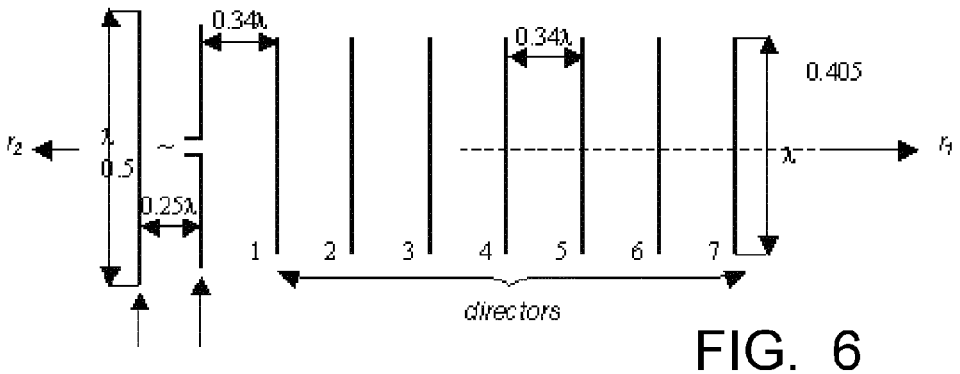
FIG. 6 diagrammatically shows typical wire lengths and spacing calculation relative to the given signal wave length.

FIG. 6 shows typical wire lengths and spacing calculation relative to the given signal wave length.

The method used for the antenna simulation is the Method of Moments, the method employed by the Numerical Electromagnetic Code (NEC) developed by Lawrence Livermore Laboratory. To use the Method of Moments, the user typically converts a conductive structure into a series of wires, creating a "wire frame model." These wires are then broken down into "segments," each segment being short compared to the wavelength of interest. Each of these segments will carry some current, and the current on each segment will affect the current on every other. To compute the currents on each segment, a set of linear equations is created and solved by the computer.

Once the current on each segment has been calculated, both near and far fields can be calculated by superposition.

The simplest model in NEC is a single wire segment, with each segment producing an electromagnetic field at every other point in space.

Assuming that the segment is (a) less than 0.1λ in length at the highest frequency of interest and (b) has a ratio of diameter to length of less than 0.1, then Maxwell's Equations can be readily solved, allowing to relate the current on the segment to the electric field some distance away.

The fields will be:

$$H_\phi = \frac{1}{4\pi} I^* \ell \sin\theta \left( \frac{j\omega}{cr} + \frac{1}{r^2} \right)$$

$$E_r = \frac{1}{2\pi\varepsilon_0} I^* \ell \cos\theta \left( \frac{1}{cr^2} + \frac{1}{j\omega r^3} \right)$$

$$E_\theta = \frac{1}{4\pi\varepsilon_0} I^* \ell \sin\theta \left( \frac{j\omega}{c^2 r} + \frac{1}{cr^2} + \frac{1}{j\omega r^3} \right)$$

where

θ, r=Coordinates: θ in radians, r in meters

I*="Retarded" current in amperes=$I_0 e^{j\omega-\beta r}$ $I_0$=Current on the segment at time t=0

1=Length of segment in meters

ω=Frequency in radians per second=2πf t=Time in seconds

β=Phase Constant=2π/λ

$\varepsilon_0$=Permittivity in air (dielectric constant)

c=Speed of light in meters/second

Therefore, if the currents on all of the segments are known, it is possible to calculate the field anywhere by superposition. Unfortunately, the fields produced by each segment affect the currents on all the others, resulting in a problem that can be solved using linear equation techniques.

The linear equations can be described in the form below, with N indicating the number of segments:

$$\begin{aligned} Z_{11} I_1 + Z_{12} I_2 + \ldots Z_{1N} I_N &= E_1 \Delta z_1 = V_1 \\ Z_{21} I_1 + Z_{22} I_2 + \ldots Z_{2N} I_N &= E_2 \Delta z_2 = V_2 \\ &\vdots \\ Z_{N1} I_1 + Z_{N2} I_2 + \ldots Z_{NN} I_N &= E_N \Delta z_N = V_N \end{aligned}$$

Here, $I_n$ is the current on segment n and $E_n$ is the electric field induced on each segment. Since field times distance equals voltage, the voltage $V_n$ on each segment is the field $E_n$ times the length $\Delta z_n$ of the segment. The parallel to Ohm's Law is intentional and, in fact, the parameter $Z_{nm}$ is the "mutual impedance" linking segments.

As NEC begins computation, it will calculate these impedances first. Once the impedances are solved for, currents can be computed at each segment. Once that is known, both near and far fields can be computed.

The analysis of the Yagi-Uda array assumes that there are K dipoles, with the last K−2 being the directors, and that the currents are sinusoidal because the antenna lengths are of the order of half-wavelength. Then, compute the mutual impedance matrix Z and the input currents $I=Z^{-1}V$. Because only the second element is driven, the vector of voltages is:

$$V = \left[ 0, 1, \underbrace{0, 0, \ldots, 0}_{(K-2)\ zeros} \right]^T$$

Once the input currents $I=[I_1, I_2, \ldots, I_K]^T$ are known, the gain of the array is computed, which simplifies into the following form because the dipoles lie along the x-axis:

$$g(\theta, \phi) = \left| \sum_{p=1}^{K} I_p \frac{\cos(kh_p \cos\theta)) - \cos kh_p}{\sin kh_p \sin\theta} e^{jkx_p \sin\theta \cos\phi} \right|^2$$

To compare the performance, the inventors have created simulation models for some different antenna types:

1. Simple PIFA antenna
   a very common printed antenna for 2.4 GHz application, along with PCBs that are used in a TLED to reflect the actual RF performance as close as possible.
2. Simple PIFA antenna with heatsink structure
   the metal heatsink structure is attached to the simple PIFA antenna. This model is to analyze the impact to the simple PIFA antenna RF radiation when the heatsink is added.
3. 3-element Yagi antenna
   the standard Yagi antenna, with minimal 3 elements, the model was modified from the stock/example antenna model from 4NEC2 suite (3elYagiMaxFB.nec), to adapt to 2.4 GHz application. This model is used as reference for a standard Yagi antenna.
4. Curved 3-element Yagi antenna
   the curved standard Yagi antenna, with minimal 3 elements, the geometry size of each Yagi antenna element is the same as the standard one, e.g., the length of each element is the same as the standard Yagi antenna, though it is curved or sitting on cylindrical surface, the distance between each element is also the same, refer to FIG. 3. This model is used to study if the RF performance is changed when the standard Yagi structure is curved.

5. Curved 3-element Yagi antenna with heatsink the PCBs and heatsink structure are attached to the curved 3-element Yagi antenna, for the simulation of the actual TLED. This model is used to compare if the RF performance is improved over the simple PIFA antenna with heatsink.

Radiation Pattern Comparison in Simulation Results

The 2D radiation patterns generated from the simulation can be used to compare the RF field strength at any cross section of the radiation field. The X-Y plane is the most interesting one, as usually the devices are roughly laid out on a flat surface like hanging from a drop ceiling in open plane office, and the performance at the X-Y plane will have much higher influence to the users.

By overlapping the 2D radiation patterns together with several antennas, one can see the relative performance differences between different antennas.

Figure 7:
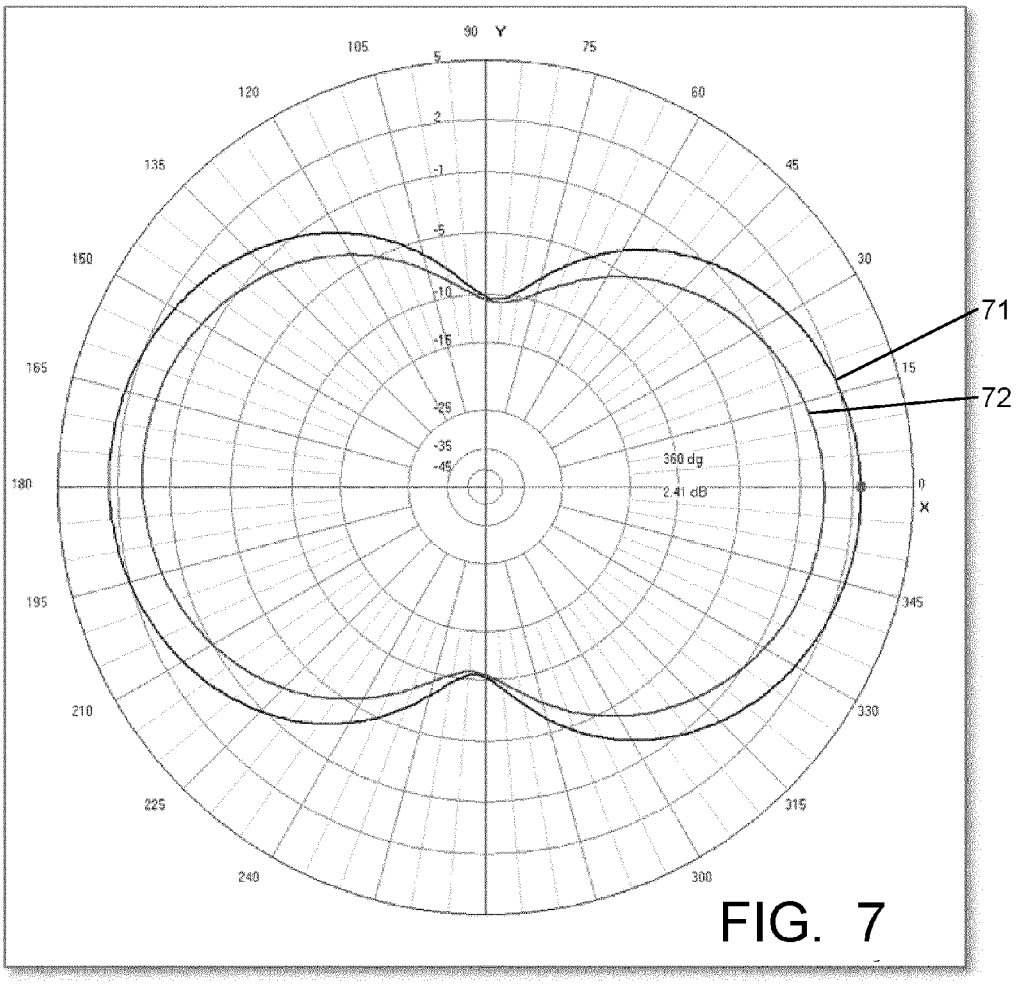
FIG. 7 shows a comparison of the 2D radiation pattern of the total antenna gain for a PIFA antenna with and without heatsink structure.

FIG. 7 shows a comparison of the 2D radiation pattern of the total antenna gain for the PIFA antenna without (curve 71) and with (curve 72) the heatsink structure. It can be seen that with the heatsink the total antenna gain is reduced by almost 2 dB in both directions of the X axis, which indicates that the heatsink reduces the RF performance along the X axis.

Figure 8:
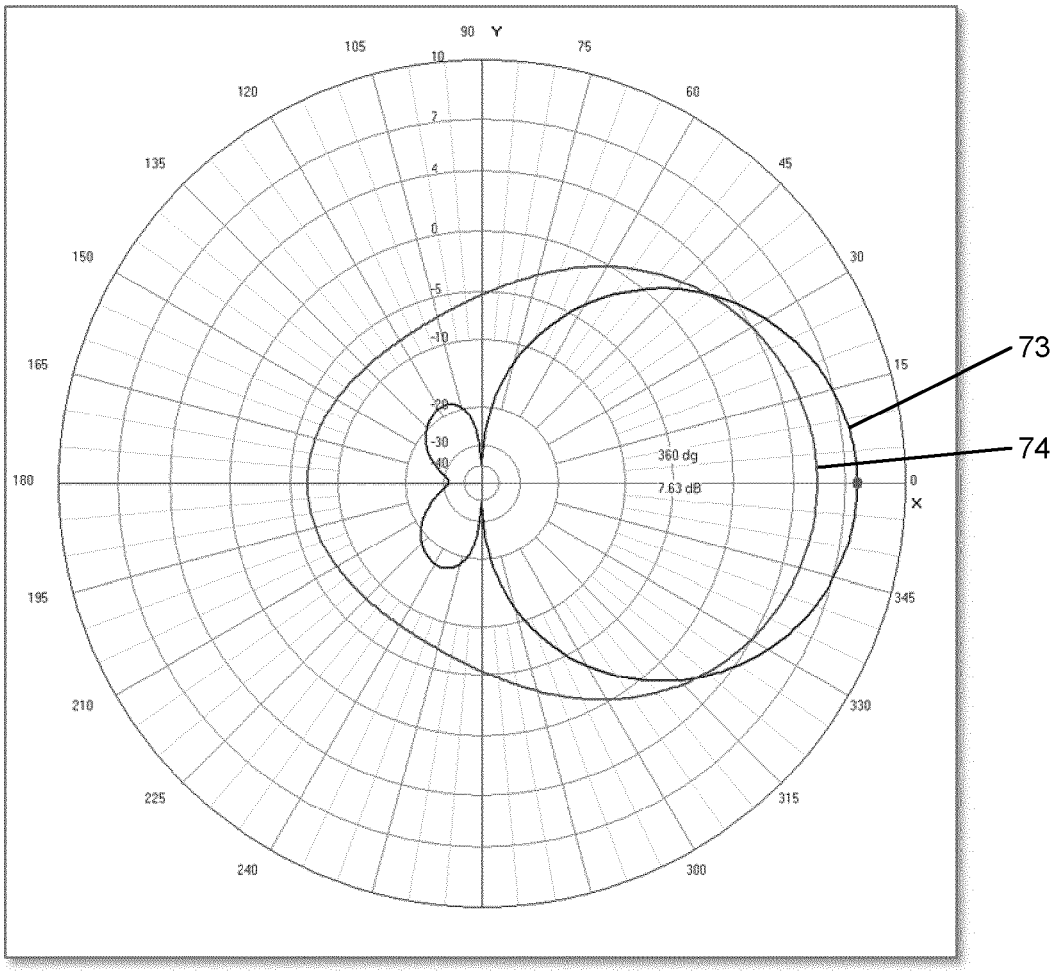
FIG. 8 shows a comparison of the 2D radiation pattern of the total antenna gain for a Yagi antenna with and without curving.

FIG. 8 shows a comparison of the 2D radiation pattern of the total antenna gain for the Yagi antenna without (curve 73) and with (curve 74) curving. It can be seen that with the Yagi antenna curved into the cylindrical shape, the directivity at the X axis of the Yagi antenna is kept but reduced a bit, by about 1 dB, which indicates that the curved Yagi antenna design concept is good. From this 2D radiation pattern, it can be seen that the curved Yagi antenna will have about 5.4 dBi gain at the positive direction of the X axis, so that it can be generally used to enhance one direction of the application, and as a second antenna to compensate weak point of the original antenna.

Figure 9:
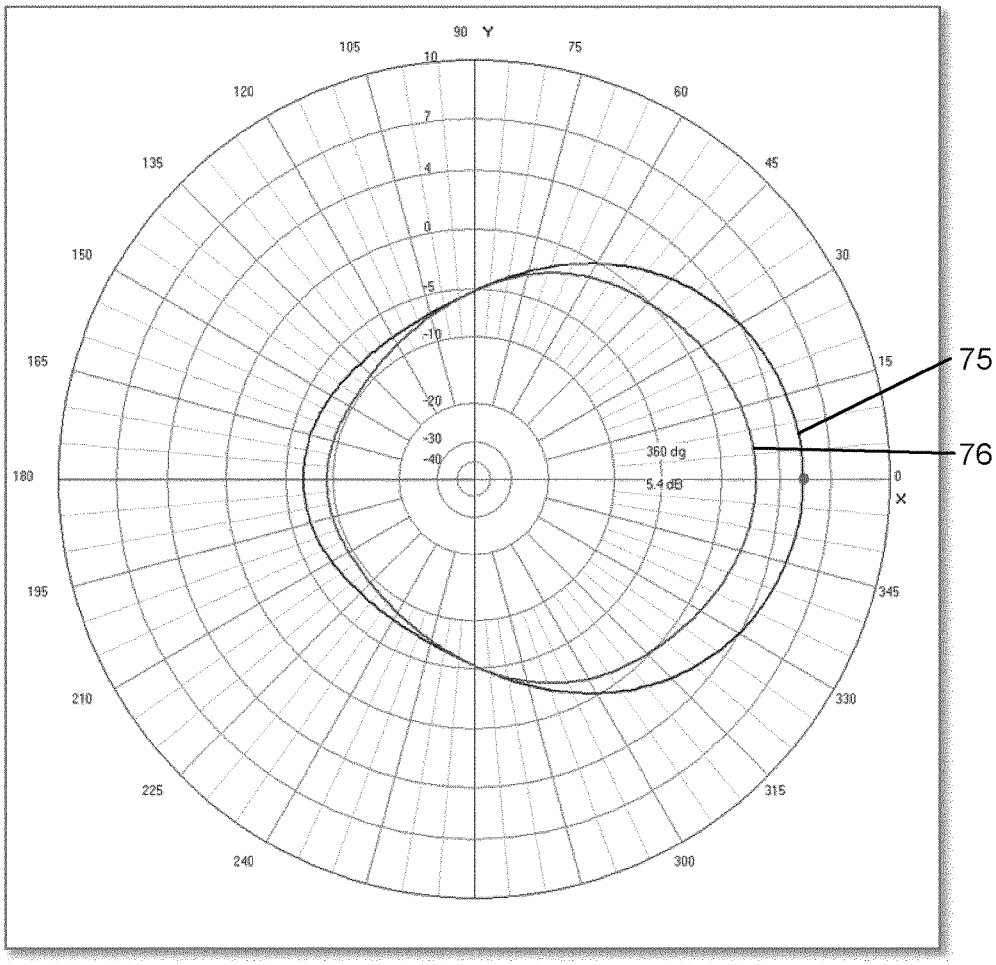
FIG. 9 shows a comparison of the 2D radiation pattern of the total antenna gain for a curved Yagi antenna before and after arranging the antenna into the actual application.

FIG. 9 shows a comparison of the 2D radiation pattern of the total antenna gain for the curved Yagi antenna before (curve 75) and after (curve 76) arranging the antenna into the actual application, which has PCBs and heatsink. It can be seen that after the curved Yagi antenna is arranged into the application, the performance is reduced by about 3 dB, but the directivity is still kept: there is about 2.4 dB gain at the positive direction of the X axis.

Figure 10:
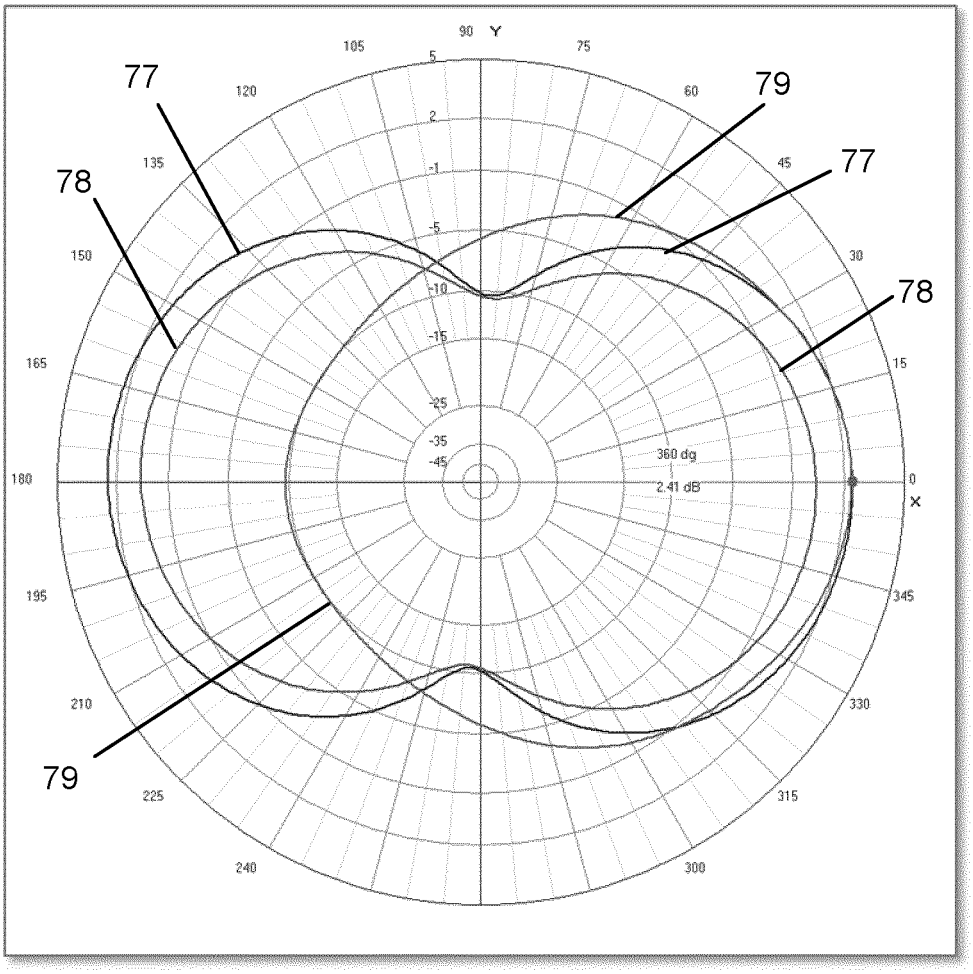
FIG. 10 shows a comparison of the 2D radiation pattern of the total antenna gain for a PIFA antenna, a PIFA antenna with heatsink and a curved Yagi antenna with heatsink.

FIG. 10 shows a comparison of the 2D radiation pattern of the total antenna gain for the PIFA antenna, the PIFA antenna with heatsink and the curved Yagi antenna with heatsink. Curve 77 shows the original PIFA antenna, with supporting PCBs. Curve 78 shows the PIFA antenna when the heatsink structure is added; the RF performance is reduced about 2 dB along the X axis. Curve 79 shows the curved Yagi antenna with exactly the same supporting PCBs and the heatsink structure; the performance is increased along the positive direction of the X axis, and is even better than the original PIFA antenna before adding the heatsink structure, so the conclusion is that the curved Yagi antenna does improve the RF performance even when the heatsink structure is added into the TLED.

Figure 11:
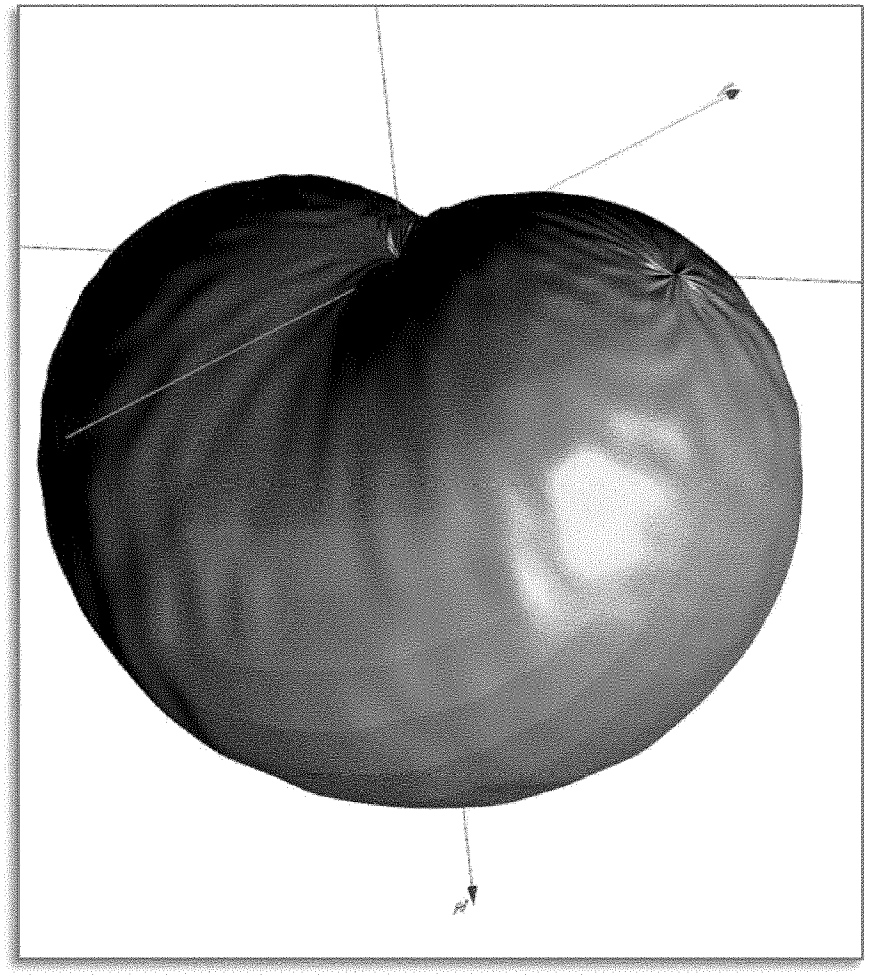
FIG. 11 shows a 3D radiation pattern for the antenna.

FIG. 11 shows a 3D radiation pattern for the antenna, which can be used to analyze the field strength at any point in the 3D space.

In the above, the present invention is specifically discussed and explained for the example of a Yagi-Uda antenna design, but the invention is not limited to a Yagi-Uda antenna design. It is however possible to apply the principles of the invention to antennas having a different design. According to the principles of the invention, all antenna elements are located in curved plane, preferably a cylindrical plane, allowing an antenna with relatively large antenna elements to be placed into an LED tube lamp. Said plane may be a virtual plane, in the case of self-supporting antenna elements. Said plane may also be implemented as a real carrier or support for antenna elements, for instance a bent sheet or a rigid holder having a curved surface onto which antenna elements are arranged. These features can be implemented for a Yagi-Uda antenna design, as shown, but can also be implemented for other types of antenna. By way of alternative example, a half-loop antenna will be described in the following.

Figure 12:
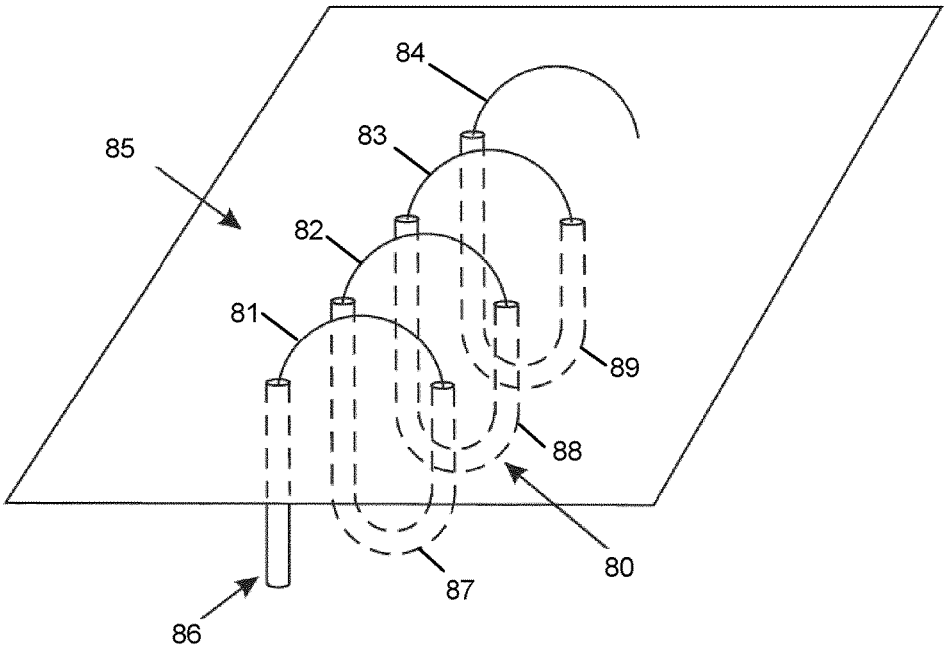
FIG. 12 is a perspective diagram schematically illustrating a half-loop wire antenna.

FIG. 12 is a perspective diagram schematically illustrating the general design of a half-loop wire antenna 80, which in this example comprises four half-loop wires 81, 82, 83, 84. Each half-loop wire 81, 82, 83, 84 is bent over 180° in accordance with a semi-circular contour. The radius of curvature is the same for all wires. It is also possible that the half-loop wires are 180° portions of a helix. The wires are aligned such that they are located on the surface of a common virtual circular cylinder, at mutually the same distance. End points of the four half-loop wires 81, 82, 83, 84 are located in a common virtual or imaginary plane 85. A feed line 86 connects to one end of the first half-loop wire 81. Transmission lines 87/88/89 connect the second end of the first/second/third wire 81/82/83 to the first end of the second/third/fourth wire 82/83/84. The feed line 86 and the transmission lines 87/88/89 are coaxial lines, i.e. they comprise an inner conductor coaxial with an outer conductor, wherein the inner conductor has the above-mentioned function of connecting while the outer conductor has the function of shielding the inner conductor in order to prevent radiation being emitted from this inner conductor. In contrast, the half-loop wires are naked wires to be able to act as antenna and emit an RF signal.

In the same way as discussed in the above, antenna 80 may be the only antenna or may be operated in conjunction with a simple antenna 6 (see FIG. 1). Two antennas 80 may be arranged at opposite ends of the tube. The antenna 80 may be arranged at an end of the lamp tube only, but it is also possible that the antenna 80 extends the full length of the tube since the wire is very thin and does not hinder the light output of the tube lamp.

Figure 13:
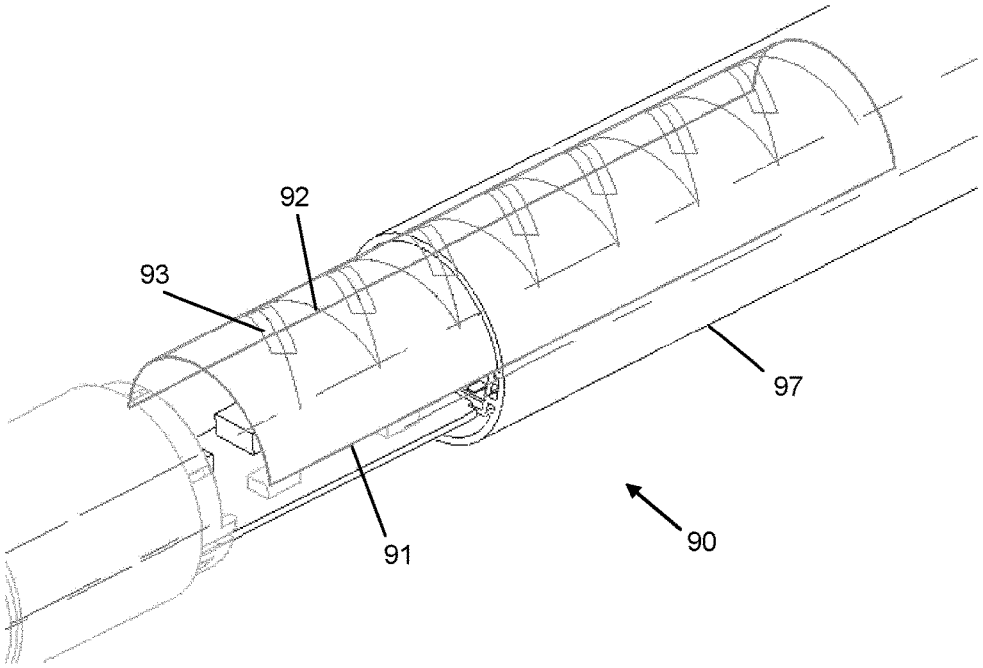
FIG. 13 is a perspective view of a possible embodiment of a half-loop wire antenna implemented for use in a tube lamp according to the present invention.

FIG. 13 is a perspective view of a half-loop wire antenna 90 implemented for use in a tube lamp according to the present invention, comparable to the embodiment of FIG. 4 and FIGS. 5A-5C. Reference numeral 97 indicates the transparent lamp tube. Reference numeral 91 indicates a flexible transparent PCB sheet, that is supported against the inner surface of the tube 97 and hence bent in accordance with the shape of the tube. Longitudinal edges of the sheet 91 support on fins of the tube or of the heat sink, comparable to the embodiments of FIGS. 5B and 5C, respectively. The PCB sheet 91 comprises conductive lines 92, that are arranged parallel to each other, and that in the bent condition of the sheet 91 extend as semi-circles or semi-ellipses or helix-portions around the longitudinal axis of the tube 97; these lines 92 in the bent condition act as the half-loop wires of the antenna. The PCB sheet 91 further comprises transmission lines 93 connecting the consecutive conduction lines 92. These transmission lines 93 are also bent lines, which follow a section of a helix path.

The coaxial array of the half-loop antenna has a much wider RF coverage, thus this antenna can be used as the only antenna, and the coverage can be adjusted by changing the number of loops. An advantage of the flexible PCB design is that it provides a simple and economic way of manufacturing the antenna, which also is easy to assemble into the tube device.

Figure 14:
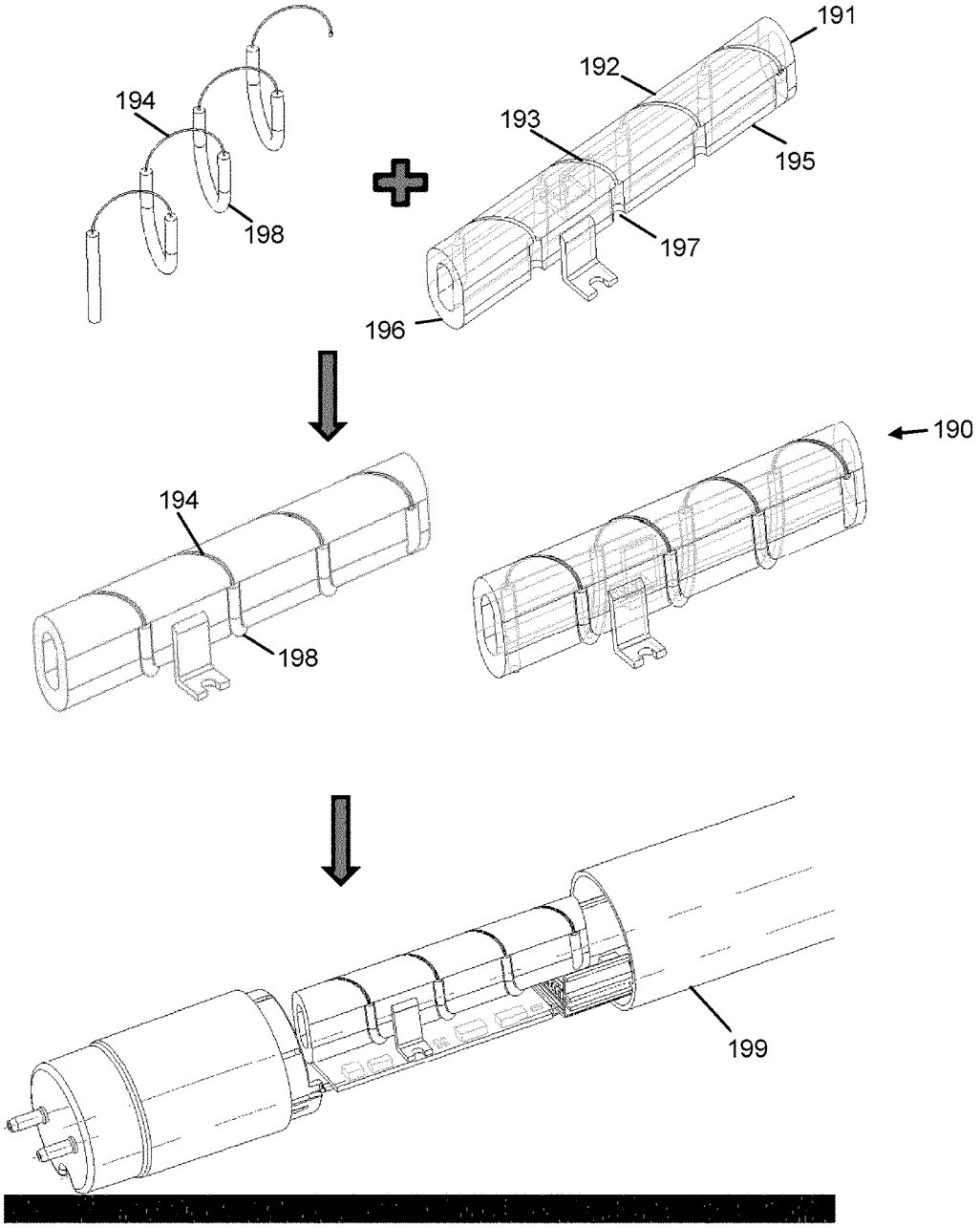
FIG. 14 is a perspective view of another possible embodiment of a half-loop wire antenna implemented for use in a tube lamp according to the present invention.

In the embodiment of FIG. 13, both the half-loop antenna lines 92 and the transmission lines 93 are located in the plane of the PCB sheet 91. The 3D antenna shape is obtained when arranging the flat sheet in the lamp tube. FIG. 14 shows a perspective view of an alternative embodiment of a half-loop wire antenna 190 that has structural 3D integrity. Reference numeral 199 indicates the transparent lamp tube. Reference numeral 191 indicates a 3D plastic frame member, that has a curved top surface 192 with 180° (i.e. semi-circular or semi-elliptical or helix-shaped) accommodation grooves 193 for accommodating half-loop antenna lines 194. Side faces 195 and curved bottom faces 196 are provided with accommodation grooves 197 for accommodating coaxial transmission lines 198 connecting the consecutive conduction lines 194. The plastic frame member 91 with integrated prefabricated accommodation grooves 193, 197 allows for higher manufacture accuracy and reproducibility of the antenna as compared to the embodiment of FIG. 13, with associated improved RF performance.

In an alternative embodiment, the half-loop antenna is printed on the transparent tube of the tube lamp. Specific ways of printing including 3D printing, ink-injecting printing of conductive material, and a similar method of manufacturing printed circuit board.

Summarizing, the present invention provides a wireless LED tube lamp device that comprises:

an at least partially transparent tube;

at least one LED arranged within said tube;

at least one LED driver;

a LED controller;

an RF antenna coupled to the controller for receiving and sending wireless commands.

The RF antenna is a curved antenna having antenna elements located in a common curved plane.

The antenna can be a Yagi-Uda antenna comprising an elongate feeder element, an elongate reflector element arranged at one side of the feeder element, and one or more elongate director elements arranged at the opposite side of the feeder element, wherein said elements are arranged in mutually parallel virtual planes perpendicular to a main transmission direction, wherein each of said elements is curved within the corresponding virtual plane around a common axis parallel to said main transmission direction.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, the antenna in the lamp device can be used for communication with a handheld remote control device, but it is also possbe that the lamp device is part of a Wifi network.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. Even if certain features are recited in different dependent claims, the present invention also relates to an embodiment comprising these features in common. Any reference signs in the claims should not be construed as limiting the scope.

The invention claimed is:

1. Wireless LED tube lamp device, comprising:

an at least partially transparent tube;

at least one LED arranged within said transparent tube;

at least one LED driver for driving said at least one LED;

a controller for controlling said at least one LED driver;

an RF antenna coupled to the controller for receiving and sending wireless commands;

wherein the RF antenna is a curved antenna having antenna elements located in a common curved plane; and wherein said antenna comprises an array of half-loop wire antenna, and said array of half-loop wire antenna comprises a plurality of coils of line, wherein the plurality of coils of line is shaped to spirally elongate along an axial direction as a whole, wherein said axial direction is parallel with the axis of the tube, and each rotation of the coils of line extends along the whole circumference of the tube.

2. The wireless LED tube lamp device according to claim 1, wherein said common curved plane is a circular cylindrical plane.

3. The wireless LED tube lamp device according to claim 1, wherein said antenna elements are self-supporting and said common curved plane is a virtual plane.

4. The wireless LED tube lamp device according to claim 1, wherein said antenna elements are arranged on a support having a rigid curved outer surface forming said common curved plane.

5. The wireless LED tube lamp device according to claim 1, wherein said antenna elements are arranged on a flexible sheet in a bent condition.

6. The wireless LED tube lamp device according to claim 5, wherein said flexible sheet comprises flexible and at least partially transparent PCB, and wherein said flexible sheet is placed within said transparent tube in contact with an inner surface of said transparent tube to obtain a bent form that conforms to the shape of the tube.

7. The wireless LED tube lamp device according to claim 1, wherein said antenna is located within said transparent tube.

8. The wireless LED tube lamp device according to claim 1, comprising two curved RF antennas arranged at opposite ends of the transparent tube.

9. The wireless LED tube lamp device according to claim 1, comprising two curved RF antennas arranged at one end of the transparent tube, mounted diametrically opposite to each other.

10. The wireless LED tube lamp device according to claim 1, wherein a first part of each rotation of the plurality of coils of line are naked conductor without shielding as a wireless radiator, and a second part of each rotation of the plurality of coils of line are coaxial cable with the conductor and encapsulating shielding.

11. The wireless LED tube lamp device according to claim 10, wherein said half-loop wire antenna are arranged on a flexible sheet in a bent condition, or wherein said half-loop wire antenna are arranged encircled around a curved surface of a 3D support frame.

12. The wireless LED tube lamp device according to claim 1, wherein said RF antenna is printed on said transparent tube.

* * * * *